United States Patent [19]

Kelly et al.

[11] 4,327,635

[45] May 4, 1982

[54] INDEXABLE MARKING WHEEL

[75] Inventors: Calvin E. Kelly, Murrysville; Robert A. Wilshire, Monroeville, both of Pa.

[73] Assignee: United States Steel Corporation, Pittsburgh, Pa.

[21] Appl. No.: 154,556

[22] Filed: May 29, 1980

[51] Int. Cl.[3] ..... B41F 17/26

[52] U.S. Cl. ..... 101/18; 101/36; 101/109; 101/23

[58] Field of Search ..... 101/109, 18, 5, 29, 101/42, 43, 22, 93.18, 35, 6, 84, 92, 93.2, 93.26, 23; 400/129, 130, 131, 132, 133, 134, 134.2, 134.3, 142, 140, 141, 141.1, 174

[56] References Cited

U.S. PATENT DOCUMENTS

| | | | |
|---|---|---|---|
| 173,232 | 2/1876 | Moore | 400/141 |
| 1,210,071 | 12/1916 | Hoffman | 101/110 X |
| 1,649,469 | 11/1927 | Grubman et al. | 101/43 X |
| 1,655,029 | 1/1928 | Tibbetts | 101/29 |
| 1,713,218 | 5/1929 | Duffie | 101/109 X |
| 2,648,279 | 8/1953 | Keuper | 235/145 R |
| 3,141,403 | 7/1964 | Brown et al. . | |
| 3,306,186 | 2/1967 | Voos et al. . | |
| 3,654,860 | 4/1972 | Speicher et al. | 101/110 |
| 3,800,696 | 4/1974 | Goto et al. | 101/6 |
| 3,898,927 | 8/1975 | Murata et al. | 101/35 X |
| 4,020,757 | 5/1977 | Christensen | 101/18 |
| 4,091,910 | 5/1978 | Bolton et al. | 101/18 X |

FOREIGN PATENT DOCUMENTS 2731849 1/1979 Fed. Rep. of Germany .

*Primary Examiner*—James R. Feyrer
*Assistant Examiner*—Charles A. Pearson
*Attorney, Agent, or Firm*—William F. Riesmeyer, III

[57] ABSTRACT

A marking apparatus is provided having a wheel with a plurality of radial slots for receipt of stamps having marking indicia thereon. An internal axially rotatable disc has a cam engageable with the stamp ends causing selected ones to protrude from the wheel periphery. A slot in the disc receives a lateral extension from each stamp for retaining them in retracted position. A segment of the slot adjacent the cam curves radially outward to allow the stamp contacted by the cam to slide outward and protrude from the wheel.

7 Claims, 7 Drawing Figures

INDEXABLE MARKING WHEEL

BACKGROUND OF THE INVENTION

This invention relates to an indexable marking apparatus, and particularly to such an apparatus for repetitive stamping of indicia or hot metal products.

In the past railroad rails and rolled structural products have been marked by a wheel containing stamps for impressing a heat number, ingot number and perhaps cut number repetitively into the product while it was still hot from the rolling operation. The stamps were contained in a clamping device in the wheel. Changing characters required unclamping the stamps, and manually removing them from the wheel and installation of ones with different characters, or in some cases removal of the entire wheel and replacement with one containing different stamps. Examples of such apparatus are shown in U.S. Pat. No. 3,163,106 Failor, U.S. Pat. No. 3,366,041 Kryorytzky, U.S. Pat. No. 3,800,696 Goto et al., and U.S. Pat. No. 4,036,127 Speicher. Obviously changing characters was time consuming and could cause considerable delay and perhaps loss of production on the mill.

Indexing of characters in rotary printers for marking paper or soft materials is known. However, these devices are generally not rugged enough, or suitable for stamping clear identifiable indicia on metal product. An example of such a printer is shown in U.S. Pat. No. 3,141,403 Brown et al which has spring loaded characters mounted circumferentially on the printing wheel. Also, means are known for indexing of stamp characters in devices which press the character into metal product while it is stationary. An example of controls for such devices is shown in German Design Patent No. 7,722,066 and in the corresponding published utility application, Offenlegungsschrift No. 2,731,849. Clearly, such devices are not suitable for repetitive stamping operations on moving product.

It is therefore a primary object of this invention to provide an indexable apparatus for repetitive stamping of hot metal products.

SUMMARY OF THE INVENTION

The apparatus of this invention includes an axially rotatable wheel with an annular flange adjacent its outer periphery. A plurality of circumferentially spaced slots extend radially through the flange for receiving a plurality of stamps slidably therein. A disc is provided which is axially rotatable and has a cam surface for abutting selected stamps for causing them to slide outward until the marking indicia thereon protrudes from the periphery of the wheel. The disc axis lies in a direction coincident with the wheel axis. A circumferential first slot is provided in the disc and has a wall parallel to the disc axis on which the cam surface is located. A second slot is located in a radial wall of the first disc slot for loosely receiving a lateral extension on each of the stamps. The second slot is substantially circular so as to retain the stamps in position retracted from the periphery of the wheel except for a segment adjacent the cam which curves radially outward in a contour substantially the same as the curvature of the cam. This latter segment permits the cam to push the stamps which it abuts outward so as to protrude from the wheel. Means is also provided for securing the disc to the wheel so that product may be marked repetitively thereby. Means preferably is provided for rotating the wheel at about the speed of the product moving in a passline tangential to the wheel. Various apparatus may be used to accomplish this e.g. a drive motor connected directly to the wheel or a drag bar for engaging the product and driving the wheel by friction. Means is also preferably provided for selectively raising the wheel out of the passline of the product. Finally, means is provided for stopping the wheel and another means then rotates the disc while the wheel is stopped so as to select a stamp having a different character thereon.

DESCRIPTION OF THE PREFERRED EMBODIMENT

Figure 1:
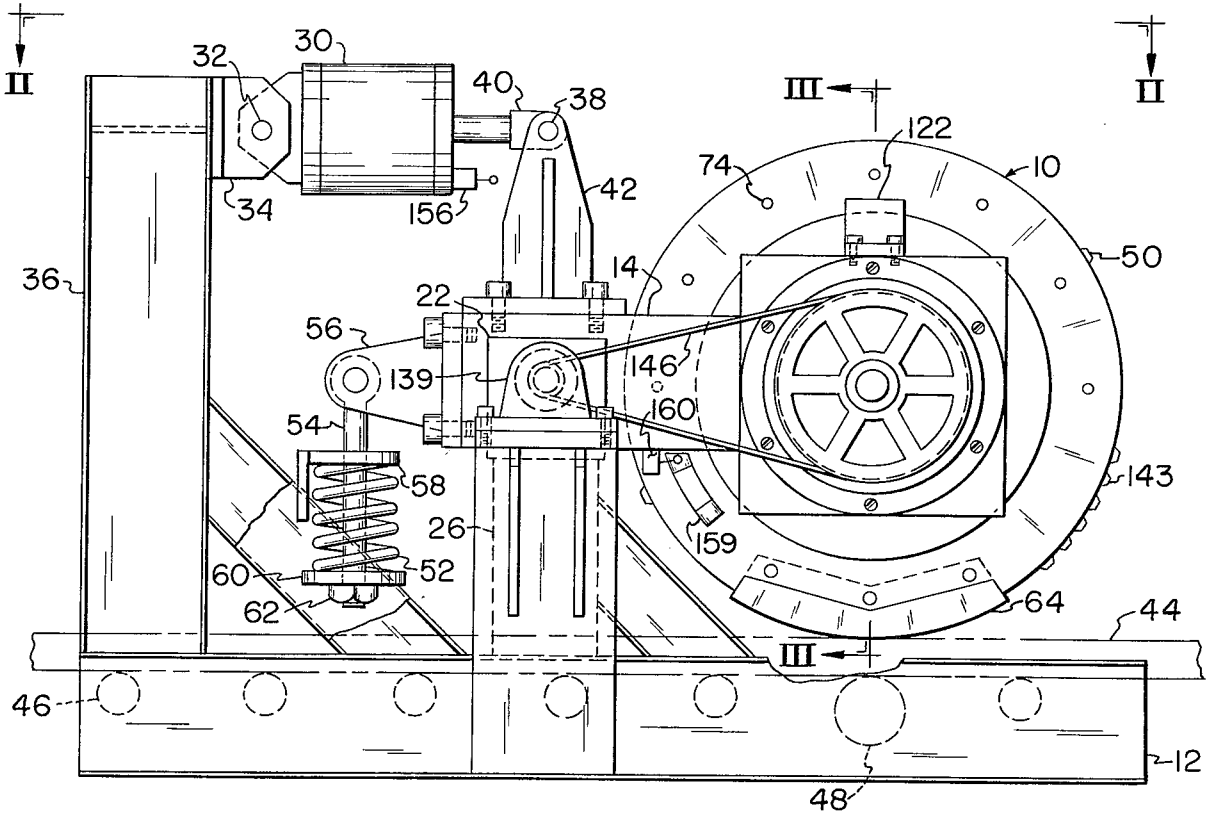
FIG. 1 is a side elevation view of the apparatus of this invention.
Figure 2:
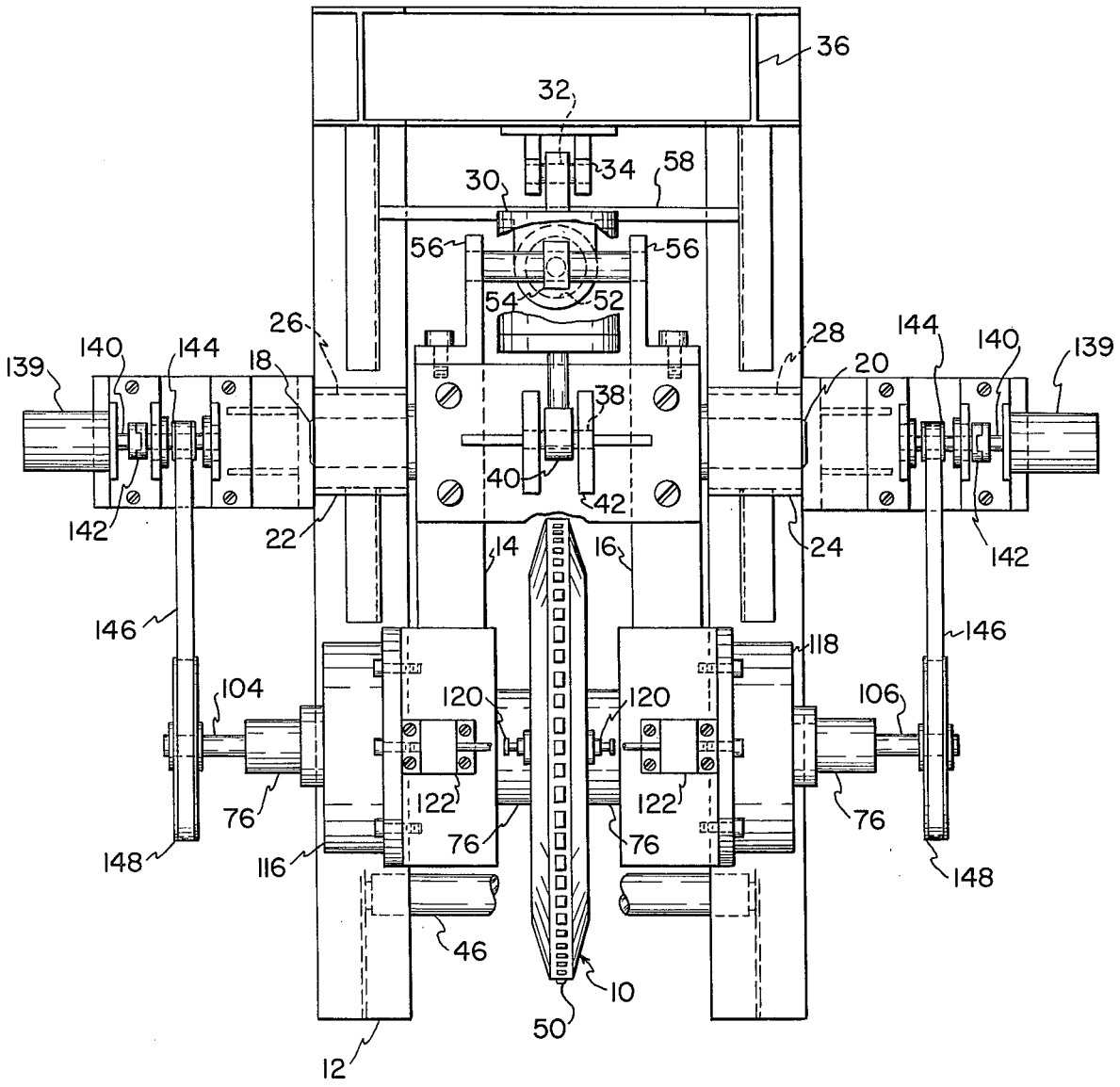
FIG. 2 is a plan view taken in the direction II—II of FIG. 1.

Referring to FIGS. 1 and 2 the apparatus of this invention includes a wheel 10 pivotally mounted in frame 12 on a pair of support arms 14, 16 (FIG. 2). Support arms 14, 16 each have a pin 18, 20 rotatably mounted in bearings 22, 24 of uprights 26, 28 of frame 12. Double acting fluid powered cylinder 30 is pivotally attached by pin 32 in clevis 34 secured to upright 36 of frame 12. Cylinder 30 is pivotally attached at its opposite end by pin 38 in clevis 40 secured in upright brace 42 secured at substantially right angles to support arms 14, 16. Thus, cylinder 30 serves as means for selectively raising or lowering wheel 10 into and out of a passline for marking product 44. Product 44 travels on conveyor rolls 46 and a bumper roller 48 opposite the point of contact of wheel 10. As will be more completely described hereinafter wheel 10 is provided with a plurality of stamps 50 each having indicia thereon for marking a hot metal product such as a railroad rail or structural bars.

Means is provided for controlling the contact pressure of wheel 10 on product 44. Spring 52 mounted on rod 54 pivotally attached to extension 56 of support arms 14 and 16 serves to counterbalance the weight of wheel 10. Spring 52 is mounted between plates 58, 60 and is adjustable by means of nut 62 on the threaded end of rod 54. Drag bar 64 secured to wheel 10 serves as means for rotating the wheel by friction at about the speed of the product passing tangentially against it. It will be apparent that the wheel may alternatively be motor driven as is well known in the art.

Figure 3:
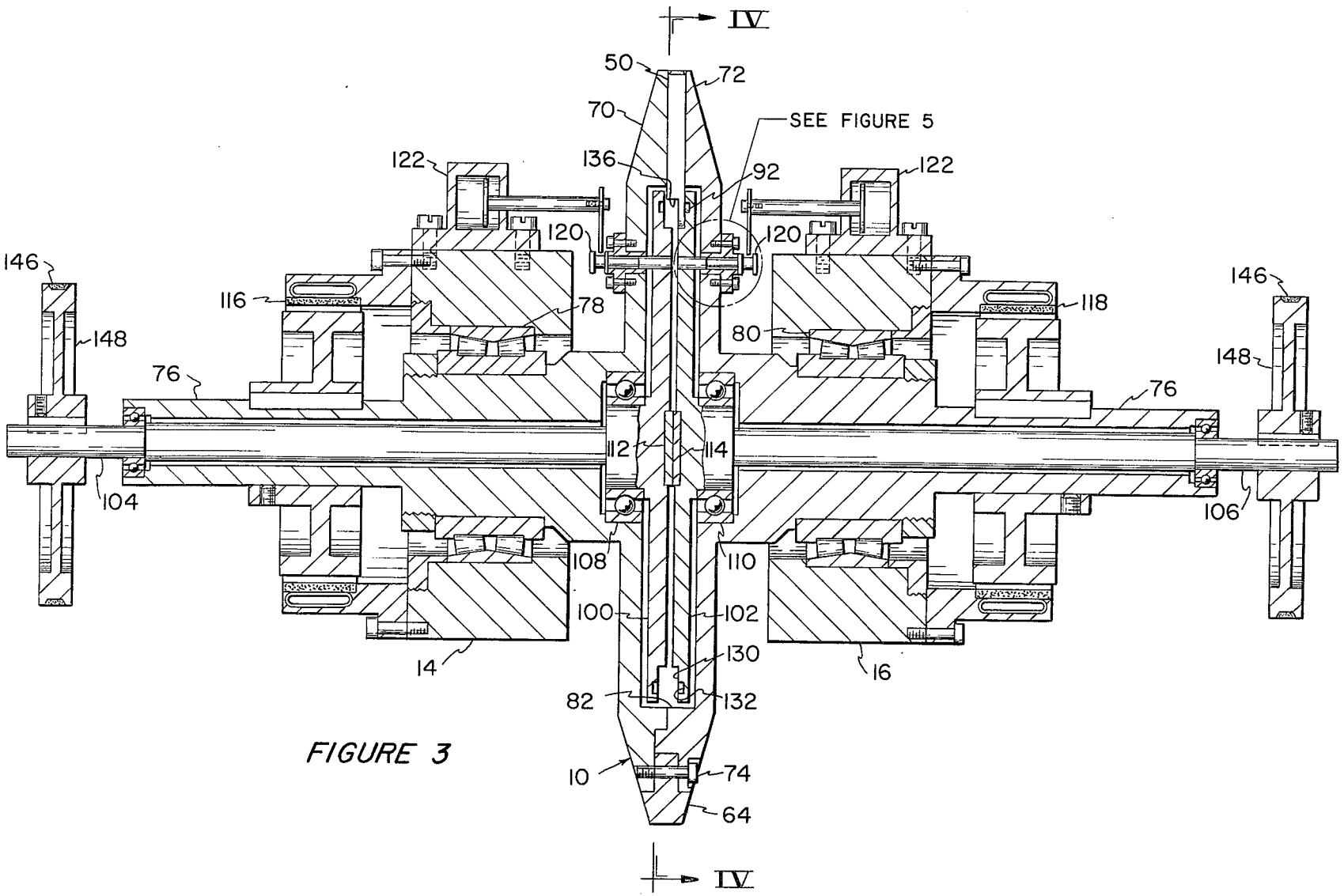
FIG. 3 is a section taken at III—III of FIG. 1.
Figure 4:
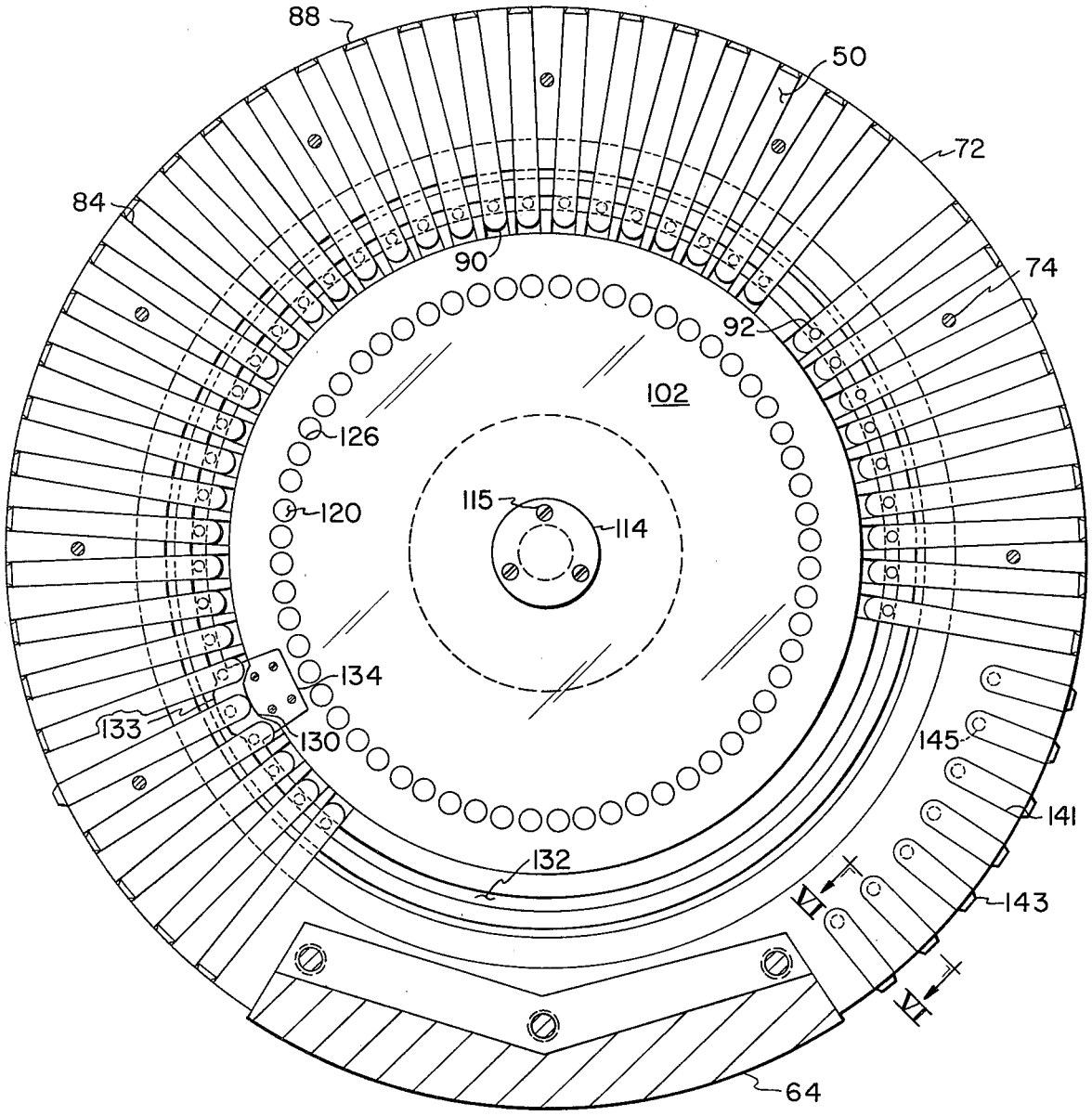
FIG. 4 is a section taken at IV—IV of FIG. 3.

Referring now to FIG. 3, wheel 10 includes half sections 70, 72 secured by circumferentially spaced cap screws 74. Sections 70, 72 each have a shaft 76 integral or separately attached thereto and rotatably mounted in preferably separable centering bearings 78, 80. Wheel 10 contains an annular flange 82 in one or both of the half sections. Flange 82 has a plurality of spaced radial slots 84 (FIG. 4) with a stamp 50 slidably mounted in each of them. Each stamp has marking indicia 88 on the end adjacent the outer periphery of the wheel and a convex curved end 90 on the opposite end. The stamps also each have a lateral extension 92 preferably a round pin as shown.

Discs 100, 102 are mounted face-to-face and have shafts 104, 106 integral therewith or attached thereto. Bearings 108, 110 permit free independent rotation of the discs with respect to the wheel. Hardened steel spacer discs 112, 114 are secured preferably by three bolts 115 to discs 100, 102 respectively between shafts 104, 106 to control side play. Means are provided for stopping the wheel and preferably include air brakes 116, 118. We use model 14CB400 brakes purchased from Faywick Corporation, Cleveland, Ohio.

Figure 5:
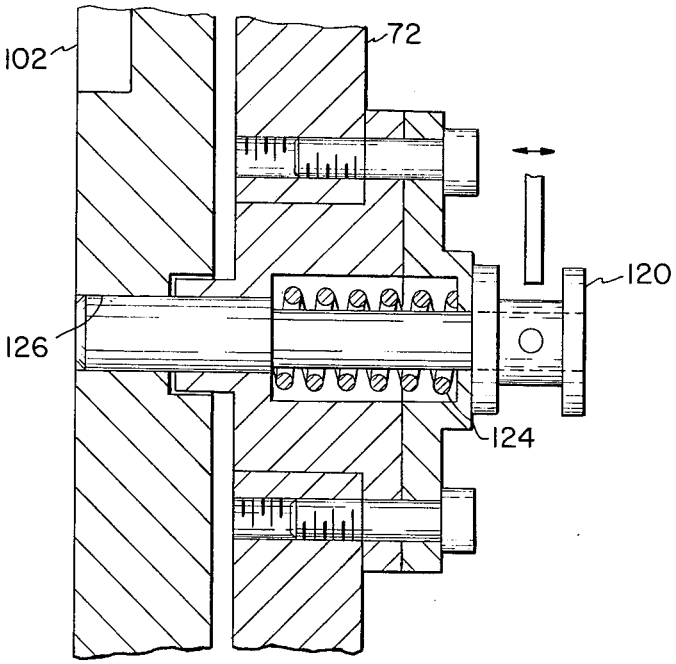
FIG. 5 is an enlarged view taken on FIG. 3.

Means for securing each disc to the wheel preferably includes a pin 120, (FIGS. 3 and 5) and fluid powered cylinder 122. Springs 124 help keep the pins inserted in discs 100, 102 in case of loss of air pressure on the cylinders. Each pin 120 is sized for tight fit into any of spaced passages 126 (FIGS. 4 and 5) corresponding to each stamp in the wheel.

Each disc has a first slot 130 (FIG. 3) extending circumferentially around its outer periphery. A second slot 132 loosely receives lateral extension 92 of all of the stamps 50. Cam 134 formed integrally with or attached to one face of slot 130 of each disc abuts the ends of the stamps as the disc is rotated. Slot 132 has a segment 133 which curves radially outward from the balance of its circular contour at a location adjacent cam 134 to allow the stamp abutted by the cam to slide radially outward until the marking indicia thereon protrudes from the outer periphery of wheel 10. Segment 133 also serves to return each stamp to its retracted position when the disc rotates the cam past it. The stamps which are indexable are arranged in two groups, the first having lateral extensions 92 engaged in slot 132 of one of the discs, the second group having the lateral extensions 92 thereof engaged in slot 132 of the other of the discs. Stamps 50 (FIG. 3) each have a cutout portion 136 on the curved end thereof to allow one of the discs and the cam thereon to pass freely therethrough. Thus the two discs are used to raise two separate stamps from the wheel and provide for example multiple digits marked on the product. Of course the same principle may be carried out with more discs depending on how many digits are required and the size of the wheel. It is also within the scope of the invention to provide adjacent rows of stamps each mounted in side-by-side radial slots in the wheel and one or more discs for each row of stamps.

Means is provided for rotating each disc separately or together to select a particular stamp for marking the product. We prefer to use stepper motors 139 each having a shaft 140 connected through clutch 142 to driver pulley 144. We use a Model SS1800-1007 motor supplied by Superior Electric Company of Bristol, Conn. and magnetic clutch couplings style MS from Stearns Electric Corporation of Milwaukee, Wis. A timing belt 146 is mounted on driver pulley 144 and disc pulley 148.

Figure 6:
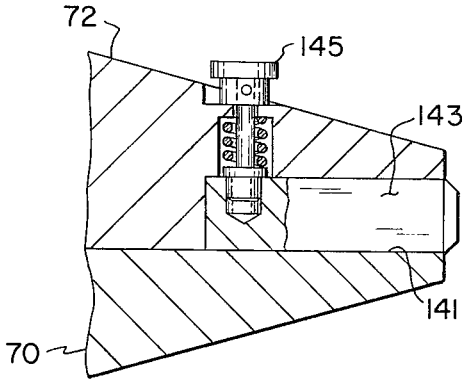
FIG. 6 is an enlarged view taken at VI—VI of FIG. 4.

For marking indicia which is changed very seldom, e.g. when stamps wear, or to provide for special markings on product 44, several radial slots 141 (see FIG. 4) are provided in flange 82 with a stamp 143 secured therein by spring actuated pin means 145 (see FIG. 6). Radial slots 141 are of the same contour as the stamps 143 which are changed manually.

Figure 7:
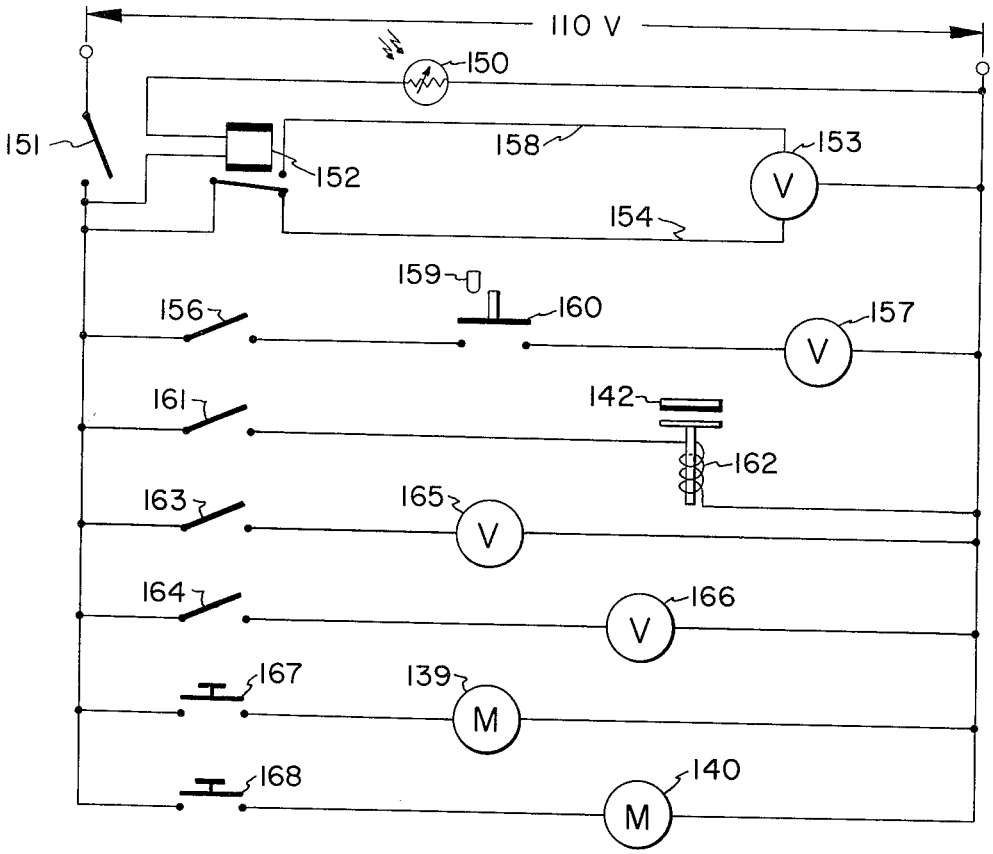
FIG. 7 is an electrical control diagram.

The control circuit shown in FIG. 7 illustrates the sequence of operation of the invention. Power is supplied to the circuit by closing manual switch 151. An infrared sensor 150 aimed at the passline adjacent the entryway becomes activated by radiation from a hot bar entering the wheel conveyor. Double contact relay 152 is tripped by the sensor so as to close the down circuit loop 154 causing solenoid valve 153 to extend the piston rod of cylinder 30. This lowers wheel 10 into the passline of product 44. As wheel 10 leaves the raised position, limit switch 156 (FIG. 1) disengages, breaking the circuit to release solenoid valve 157 and pneumatic brakes 116, 118. This frees the wheel so that it will rotate and repetitively mark the product when contacted thereby. When the trailing end of product 44 passes, the infrared sensor deactivates causing relay 152 to trip and close the raise loop 158 through solenoid valve 153 while also opening loop 154. Thus, the piston rod of cylinder 30 retracts and raises wheel 10 out of the passline. When wheel 10 reaches its upper position it trips and closes limit switch 156. Wheel 10 is of course continually revolving due to momentum as it is raised. Cam 159 (FIG. 1) trips switch 160 each time the wheel revolves. On the first revolution after switch 156 is closed, switch 160 closes and completes the circuit loop through solenoid valve 157 simultaneously actuating both pneumatic brakes 116, 118. This stops the wheel. Cam 159 is spaced from drag bar 64 a distance corresponding approximately to the time wheel 10 will take to rotate (at its normal speed from gathered momentum due to contact by product 44) so that drag bar 64 will be properly positioned at the bottom of wheel 10 when the wheel stops so as to be engaged first by another succeeding bar product. After wheel 10 is in the raised position, and fully stopped, switch 161 is manually closed so as to energize solenoid 162 to engage clutches 142. Switches 163 and 164 are then manually closed to energize solenoid valves 165 and 166 to retract the piston rods of cylinders 122 disengaging pins 120, from discs 100, 102 respectively. This frees the discs for rotation independently of wheel 10 so that different stamps 50 may be selected. Then, either or both of switches 167, 168 are manually closed to activate stepper motors 139, 140. Switches 167, 168 are of spring return type so that each time they are closed the stepper motor controlled thereby is advanced one step which is preset in the control box for the motor. Each step is equivalent to a certain number of pulses corresponding to the equal angular spacing between stamps in the wheel. It will be apparent that other controls may be devised for the stepper motors. An example of such controls including an indicator for directly monitoring the actual position of the wheel is shown in West German Design Patent No. 7,722,066, the specification of which is incorporated herein by reference. Switches 163 and 164 are manually opened de-energizing solenoid valves 165 and 166 which, return the piston rods of cylinders 122 to re-engage pins 120 with discs 100 and 102 respectively, thus locking the discs 100 and 102 to wheel 10. Switch 161 is then manually opened which de-energizes solenoid 162 and disengages clutch 142. The wheel 10 is then ready to be lowered when another bar trips the infrared sensor as described above and the marking cycle is repeated.

We claim:

1. A marking apparatus, comprising:

an axially rotatable wheel having an annular flange with circumferentially spaced slots extending radially therethrough, a plurality of stamps mounted in said slots and each having marking indicia on one end thereof adjacent the outer periphery of said wheel and a convex curved surface on the opposite end thereof adjacent the wheel axis, said stamps being slidable in the radial direction in said slots and of greater length than said slots in said radial direction, said stamps each having a lateral extension, generally parallel to the wheel axis, on a portion thereof protruding from the end of the slots adjacent the wheel axis, an axially rotatable disc having the axis thereof lying in a direction coincident with the axis of said wheel, said disc having a circumferential first slot and a substantially circular second slot located in a radial sidewall of the first slot loosely receiving the lateral extensions of said stamps so as to generally retain said stamps in a position retracted from the periphery of the wheel, said disc also having a radially protruding curved cam surface on a wall of the first slot which extends generally parallel to the disc axis, said second disc slot having a segment curving radially outward from and inward rejoining the balance of the circular portion thereof at a location adjacent said cam surface, said segment having a contour substantially the same as said cam surface so as to permit a stamp contacted on the curved end thereof by said cam surface to slide radially outward and inward in said slot until the marking indicia on said stamp protrudes from the periphery of the wheel, means for selectively securing said disc to said wheel, means for selectively stopping said wheel to prevent angular rotation thereof, and means for rotating said disc while said wheel is stopped to select different stamps for marking a product.

2. The apparatus of claim 1 further comprising means for rotating said wheel for repetitive marking of said product.

3. The apparatus of claim 1 further comprising means for selectively raising said wheel out of a passline in which said product is travelling.

4. The apparatus of claim 1 wherein said disc has a plurality of circumferentially spaced lateral passages therein corresponding to positions of each of the stamps in said wheel when said disc is aligned so that the cam surface thereon pushes said stamp outward from the periphery of the wheel, the means for securing the disc to the wheel includes a pin mounted on said wheel substantially normal to a broad face thereof and fluid powered cylinder means for forcing said pin into or out of one of said passages in said disc.

5. The apparatus of claim 1 further comprising a second disc the same as the first and mounted face-to-face therewith, means for selectively securing said second disc to the wheel, and means for rotating said second disc independently of any rotation of said first disc while said wheel is stopped, and wherein each of said stamps have a cutout portion of about one half of the cross section of the curved end thereof such that the cam surface on one of said discs may pass through the cutout without contacting said stamps, said stamps being arranged in two groups, the first group having the curved end and lateral extension thereof adjoining one of said discs and the second group having the curved end and lateral extensions thereof adjoining the other of said discs.

6. The apparatus of claim 2 wherein the means for rotating said wheel includes a drag bar for engagement by product moving tangentially with respect to said wheel, said bar extending around a segment of the circumference of said wheel and protruding from the periphery of said wheel substantially the same distance as the marking indicia on stamps protruding therefrom.

7. The apparatus of claim 1 wherein at least one of said slots does not extend completely through the annular flange of said wheel on the side thereof adjacent the wheel axis, and further comprising spring loaded pin means mounted on a broad face of the wheel for selectively engaging a passage in a stamp to be mounted in said slot and releasably securing said stamp in fixed position with marking indicia thereon protruding from the periphery of said wheel.

* * * * *